US009439468B1

(12) United States Patent
Blagg et al.

(10) Patent No.: US 9,439,468 B1
(45) Date of Patent: Sep. 13, 2016

(54) PROTECTIVE ATHLETIC HELMET

(71) Applicants: Ethan Wayne Blagg, Edmond, OK (US); Jessica Ann Lukowski, Edmond, OK (US); Matthew Thomas Smith, Edmond, OK (US); Jimmy Bollman, Oklahoma City, OK (US)

(72) Inventors: Ethan Wayne Blagg, Edmond, OK (US); Jessica Ann Lukowski, Edmond, OK (US); Matthew Thomas Smith, Edmond, OK (US); Jimmy Bollman, Oklahoma City, OK (US)

( * ) Notice: Subject to any disclaimer, the term of this patent is extended or adjusted under 35 U.S.C. 154(b) by 0 days.

(21) Appl. No.: 14/744,351

(22) Filed: Jun. 19, 2015

(51) Int. Cl.

| | |
|---|---|
| ***A42B 3/06*** | (2006.01) |
| ***A42B 3/10*** | (2006.01) |
| ***A42B 3/12*** | (2006.01) |
| ***A42B 3/20*** | (2006.01) |

(52) U.S. Cl.
CPC ..... *A42B 3/06* (2013.01); *A42B 3/105* (2013.01); *A42B 3/125* (2013.01); *A42B 3/20* (2013.01)

(58) Field of Classification Search
CPC ..... A42B 3/00; A42B 3/06; A42B 3/122; A42B 3/127
USPC ..... 2/411, 412, 413, 414, 425
See application file for complete search history.

(56) References Cited

U.S. PATENT DOCUMENTS

| | | | | |
|---|---|---|---|---|
| 3,820,163 | A | 6/1974 | Rappleyea | |
| 3,872,511 | A * | 3/1975 | Nichols | A42B 3/121 2/413 |
| 4,504,604 | A | 3/1985 | Pilkington et al. | |
| 4,586,200 | A * | 5/1986 | Poon | A42B 3/122 2/413 |
| 5,815,846 | A * | 10/1998 | Calonge | A42B 3/121 2/413 |
| 6,332,226 | B1 | 12/2001 | Rush, III | |
| 6,996,856 | B2 | 2/2006 | Puchalski | |
| 8,756,719 | B2 * | 6/2014 | Veazie | A42B 3/121 2/411 |
| 8,844,066 | B1 | 9/2014 | Whitcomb | |
| 2008/0155735 | A1 | 7/2008 | Ferrara | |
| 2008/0256686 | A1 | 10/2008 | Ferrara | |
| 2010/0186150 | A1 | 7/2010 | Ferrara et al. | |
| 2011/0271428 | A1 | 11/2011 | Withnall et al. | |
| 2014/0033411 | A1 | 2/2014 | Kisailus et al. | |
| 2014/0208486 | A1 | 7/2014 | Krueger | |

FOREIGN PATENT DOCUMENTS

CN 202496476 U 10/2012

OTHER PUBLICATIONS

Sorbothane, Inc., Innovative Shock and Vibration Solutions, www.sorbothane.com, Jun. 12, 2015, USA.
Skydex, Technology, www.skydex.com/technology, Jun. 12, 2015, USA.
Jason M. Breslow, High School Football Players Face Bigger Concussion Risk, Oct. 31, 2013, USA, www.pbs.org.
Snejana Farberov, New York High School Football Player, 16, dies from head injury after helmet-to-helmet collision, Sep. 17, 2013, USA, www.dailymail.co.uk/news.

(Continued)

*Primary Examiner* — Tejash Patel
(74) *Attorney, Agent, or Firm* — D. Ward Hobson

(57) ABSTRACT

A protective athletic helmet configured to reduce or prevent head injuries such as concussions. The protective athletic helmet including a durable outer shell, a shock absorbent middle layer, and a flexible inner shell. The shock absorbent middle layer including a plurality of shock absorbent hemispheres positioned adjacent to a plurality of foam pads. The outer durable shell and the inner flexible shell configured to permit the durable outer shell to move independently from the flexible inner shell and to permit the shock absorbent middle layer to absorb energy resulting from an impact force to the outer surface of the durable outer shell.

12 Claims, 6 Drawing Sheets

(56) References Cited

OTHER PUBLICATIONS

Associated Press, NFL, ex-players agree to $765M settlement in concussion suit, Aug. 29, 2013, USA, www.nfl.com/news.

NCAA, SSI Task Force Explores Issues, Challenges Around Concussions, ncaa.org, USA, Jun. 15, 2015.

Xenith, Football helmets, shoulder pads, facemasks, www.xenith.com, USA, Jun. 12, 2015.

* cited by examiner

PROTECTIVE ATHLETIC HELMET

BACKGROUND

Individuals participating in contact sports, such as football, hockey, or baseball, and other physical activities may suffer injuries to the head and neck. Sometimes, significant damage may occur causing concussions, brain damage, skull fractures, paralysis, and even death. Protective athletic helmets can provide head and neck protection for individuals participating in such contact sports and other physical activities and can help reduce and sometimes prevent head and neck injuries.

For example, football players often wear protective athletic helmets to help reduce or prevent injury to the head caused by frequent collisions with other players and the ground. Such protective athletic helmets often include a shell, an internal padding assembly, and a chin protector or strap that secures the protective athletic helmet to a user's head. Unfortunately, however, such protective athletic helmets often lack adequate shock absorption, are too heavy, or in some cases lack adequate rigidity or flexibility to effectively protect a user's head and reduce or prevent injury. While current protective athletic helmets may be effective at reducing some single impact injuries to the head such as skull fractures, such protective athletic helmets are often less effective at reducing or preventing multiple impact head injuries such as concussions.

To that end, it would be advantageous to provide an improved light-weight protective athletic helmet configured to help reduce or prevent multiple impact head injuries such as concussions. The improved protective athletic helmet utilizes a durable outer shell, a flexible inner shell, and a shock absorbent middle layer. The shock absorbent middle layer includes a plurality of shock absorbent hemispheres and a plurality of foam pads. The outer durable shell is configured to move independently from the inner flexible shell and the shock absorbent middle layer, so as to absorb and redirect energy resulting from an impact force to the durable outer shell. It is to such an improved protective athletic helmet and to methods for using thereof that exemplary embodiments of the inventive concepts disclosed and claimed herein are directed.

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1:
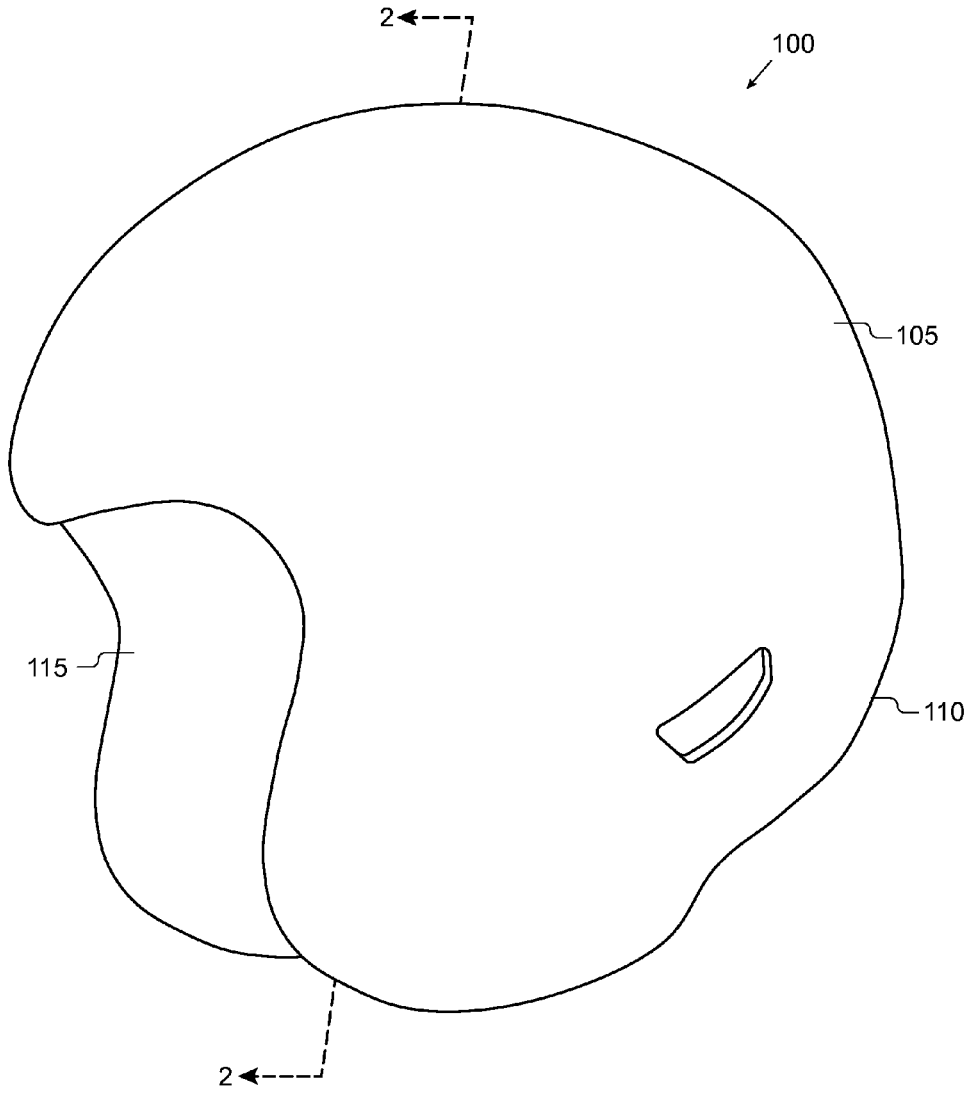
FIG. 1 is a perspective view of an exemplary embodiment of a protective athletic helmet according to the inventive concepts disclosed herein.

Before explaining at least one embodiment of the inventive concepts disclosed herein in detail, it is to be understood that the inventive concepts are not limited in their application to the details of construction and the arrangements of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed.

The notation "a-n" if appended to a reference numeral is intended as merely convenient shorthand to reference one, or more than one, and up to infinity, of the element or feature identified by the respective reference numeral (e.g., 100*a-n*). Similarly, a letter following a reference numeral is intended to reference an embodiment of the feature or element that may be similar, but not necessarily identical, to a previously described element or feature bearing the same reference numeral (e.g., 105, 105*a*, 105*b*, etc.). Such shorthand notations are used for purposes of clarity and convenience only, and should not be construed to limit the instant inventive concept(s) in any way, unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment.

The appearances of the phrase "in one embodiment" in various places in the specification are not necessarily all referring to the same embodiment.

The inventive concepts disclosed herein are generally directed to protective athletic helmets configured to protect the head of a user. It should be noted and understood, however, that while the protective athletic helmets described herein are configured to reduce or prevent injuries, due to the nature of contact sports and other physical activities, no protective athletic helmet can completely eliminate all injuries.

Referring now to FIGS. 1-4, shown therein is an exemplary embodiment of a protective athletic helmet 100 constructed according to the inventive concepts disclosed herein. The protective athletic helmet 100 includes a durable outer shell 105 having an outer surface 110 and an inner surface 115. The durable outer shell 105 is configured to be contoured to the shape of a user's head. The protective athletic helmet 100 also includes a shock absorbent middle layer 120 configured to be contoured to the shape of a user's head. The shock absorbent middle layer 120 is detachably connected to a portion of the inner surface 115 of the durable outer shell 105. The shock absorbent middle layer 120 includes a plurality of shock absorbent hemispheres 130 having top and bottom ends 135 and 140. The shock absorbent middle layer 120 also includes a plurality of foam pads 145 having top and bottom ends 150 and 155. The plurality of shock absorbent hemispheres 130 are positioned adjacent to the plurality of foam pads 145. The protective athletic helmet 100 includes a flexible inner shell 160 having an outer surface 165 and an inner surface 170. The outer surface 165 of the flexible inner shell 160 is detachably connected to the bottom ends 140 of the plurality of shock absorbent hemispheres 130 and the bottom ends 155 of the foam pads 145. The flexible inner shell 160 is configured to receive a user's head. The outer durable shell 105 and the inner flexible shell 160 are configured to permit the durable outer shell 105 to move independently from the flexible inner shell 160 and to permit the shock absorbent middle layer 120 to absorb energy resulting from an impact force to the outer surface 110 of the durable outer shell 105.

Referring now to FIG. 1, the durable outer shell 105 includes an outer surface 110 and an inner surface 115. The durable outer shell 105 is configured to be contoured to the shape of a user's head. The durable outer shell 105 may be any desired shape sufficient to protect the head of a user, including a substantially circular, oval, square, or rectangular shape. In some embodiments the durable outer shell 105 may be substantially circular in shape, while in some embodiments, the durable outer shell may be substantially square or may have any other desired shape, as will be appreciated by persons of ordinary skill in the art having the benefit of the instant disclosure.

The durable outer shell 105 may be constructed from any desired material that is sufficiently durable and sufficiently lightweight to protect a user of the protective athletic helmet 100. For example, the durable outer shell 105 may be constructed from carbon fiber, carbon fiber tiles, layered or crossed carbon fiber, reinforced carbon fiber, co-polypropylene, plastics, ceramics, polymers, metals, alloys, non-metals, resins, composite materials, combinations thereof, and the like. Preferably, the durable outer shell 105 is formed from carbon fiber, carbon fiber tiles, or layered, crossed, or reinforced carbon fiber. Carbon fiber provides a durable and lightweight material consisting of thin, strong crystalline filaments of carbon. In some embodiments, the durable outer shell 105 may have a thickness of approximately ⅛ of an inch. While, in other embodiments, the durable outer shell 105 may have a thickness less than ⅛ of an inch or greater than ⅛ of an inch, depending upon the desired weight of the protective athletic helmet 100. While carbon fiber is preferred, it should be understood, that the durable outer shell 105 may be constructed from any material that is sufficiently durable and lightweight to protect a user of the protective athletic helmet 100. Further, in some embodiments, the durable outer shell 105 may also include reinforcing or bracing structures, such as struts, ribs, braces, rods, or any other suitable reinforcing or bracing structure, or combinations thereof.

Figure 2:
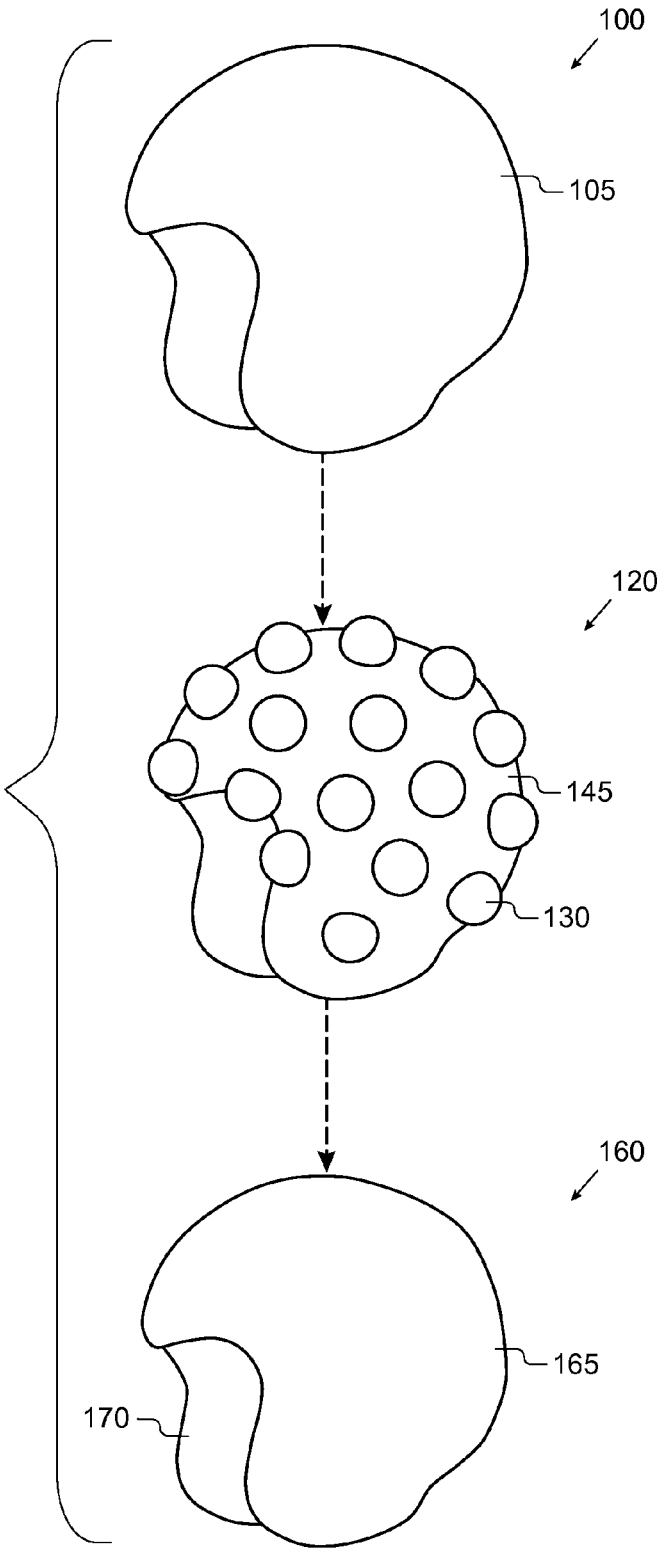
FIG. 2 is an exploded view of the protective athletic helmet of FIG. 1.

Referring now to FIG. 2, the shock absorbent middle layer 120 includes a plurality of shock absorbent hemispheres 130 having a top end 135 and a bottom end 140. The shock absorbent middle layer 120 also includes a plurality of foam pads 145 having a top end 150 and a bottom end 155. The plurality of shock absorbent hemispheres 130 are positioned adjacent to the plurality of foam pads 145. The shock absorbent middle layer 120 is configured to be contoured to the shape of the inner surface 115 of the durable outer shell 105 and to fit underneath the durable outer shell 105.

The shock absorbent middle layer 120 is detachably connected to a portion of the inner surface 115 of the durable outer shell 105. The shock absorbent middle layer 120 may be detachably connected to the inner surface 115 of the durable outer shell 105 via adhesives, snaps, hinges, fasteners, Velcro, or any other form of connector known in the art. The shock absorbent middle layer 120 may be detachably connected to a portion of the inner surface 115 of the durable outer shell 105 by connecting the top ends 135 of the plurality of shock absorbent hemispheres 130 to the inner surface 115 of the durable outer shell 105. The shock absorbent middle layer 120 may also be detachably connected to the inner surface 115 of the durable outer shell 105 by connecting the top ends 150 of the foam pads 145 to the inner surface 115 of the durable outer shell 105. Alternatively, both the foam pads 145 and the plurality of shock absorbent hemispheres 130 may be detachably connected to the inner surface 115 of the durable outer shell 105.

The shock absorbent middle layer 120 is configured to be detachably connected to a portion of the inner surface 115 of the durable outer shell 105, so that the shock absorbent middle layer can be removed, replaced, and or repaired, if needed. Further, the shock absorbent middle layer 120 is configured to be detachably connected to the inner surface 115 of the durable outer shell 105 so as to permit the durable outer shell 105 to move independently from the shock absorbent middle layer 120 and to absorb energy resulting from an impact force to the outer surface 110 of the durable outer shell 105. However, one of ordinary skill in the art having the benefit of the instant disclosure would readily appreciate that in some embodiments, the shock absorbent middle layer 120 may be permanently or semi-permanently connected to the durable outer shell 105 so as to provide greater stability or rigidity to the protective athletic helmet 100.

Figure 3:
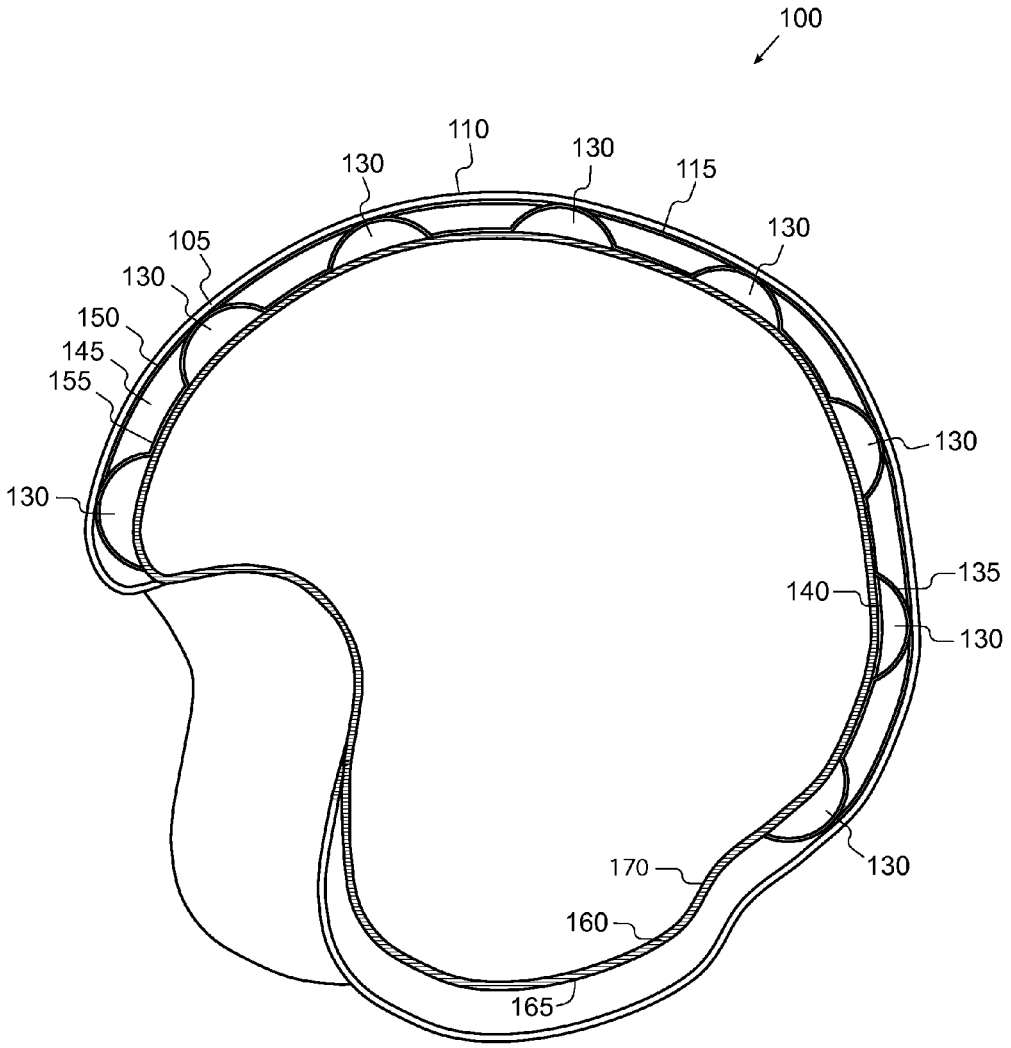
FIG. 3 is a cross-sectional side view taken along line 2-2 of FIG. 1.

Referring now to FIG. 3, the shock absorbent middle layer 120 includes a plurality of shock absorbent hemispheres 130 having top and bottom ends 135 and 140. The shock absorbent hemispheres 130 are configured so that the bottom end 135 is substantially flat and circular and the top end 140 is substantially curved in the shape of a hemisphere. The hemisphere shape of the shock absorbent hemispheres 130 helps to absorb and dissipate energy from an impact force to the durable outer shell 105. The shock absorbent hemispheres 130 are shaped so as to bend, twist, and contract and expand, upon an impact force to the durable outer shell 105. Thus allowing the durable outer shell 105 to move independently from the flexible inner shell 160 and provide enhanced shock absorption and protection to the head of a user of the protective athletic helmet 100. In some embodiments, the shock absorbent hemispheres 130 may have a diameter of approximately 1.25 inches and a hardness of approximately 50 D based on a durometer scale. In other embodiments, the shock absorbent hemispheres 130 may have a diameter of approximately ¾ of an inch, or a greater or lesser diameter and a greater or lesser hardness, as will be appreciated by one of ordinary skill in the art having the benefit of the instant disclosure.

The plurality of shock absorbent hemispheres 130 may be constructed from any desired material sufficient to absorb or redirect the force of an impact to the durable outer shell 105. For example, the plurality of shock absorbent hemispheres may be formed from Sorbothane, rubber, neoprense, silicone, visco-elastic polymers, polyurethane, thermoset polyether-based polyurethane, plastic, composites, combinations thereof, and the like. Sorbothane is a visco-elastic polymer that is formed from a thermoset, polyether-based, polyurethane material. In addition to being visco-elastic, Sorbothane has a high damping coefficient, which makes it a preferred material for constructing the shock absorbent hemispheres 130. In contrast to hollow or liquid filled compression cells, for example, solid visco-elastic polymers exhibit properties of both liquids and solids. Visco-elastic behavior is desirable for the shock and vibration absorption of the plurality of shock absorbent hemispheres 130. A viscous material deforms under load and transmits forces in all directions. Viscous materials also distribute a small amount of pressure over a large area, and does not recover its shape when a load is removed. An elastic material deforms under load and returns to its original shape when that load is removed. Thus, durable visco-elastic polymeric solids, which can flow like a liquid under load, but which can retain their shape after an impact are preferable materials for the shock absorbent hemispheres 130.

As shown in FIGS. 2-3, the plurality of shock absorbent hemispheres 130 are positioned throughout the shock absorbent middle layer 120. In some embodiments, the shock absorbent hemispheres 130 may be positioned at a front, a back, or a first and second side position of the shock absorbent middle layer 120 so as to provide increased shock absorption and protection where impact forces to the durable outer shell 105 are most likely to occur. In some embodiments the shock absorbent hemispheres 130 may be clustered or grouped together to provide increased shock absorption. Further, in some embodiments the shock absorbent hemispheres 130 may be evenly distributed and positioned throughout the shock absorbent middle layer 120.

The number of shock absorbent hemispheres 130 in the shock absorbent middle layer 120 is preferably between 10 and 20. However, as will be readily apparent to one of ordinary skill in the art having the benefit of the instant disclosure, the number of shock absorbent hemispheres 130 may vary, depending upon the desired weight of the protective athletic helmet 100 and the intended use. As one of ordinary skill in the art will readily appreciate with the benefit of the instant disclosure, in some embodiments, the number of shock absorbent hemispheres 130 may be at a number varying between 2 and 10, or between 10 and 20, or between 20 and 30, or between 30 and 50, for example.

As shown in FIGS. 2-3, the shock absorbent middle layer 120 includes a plurality of foam pads 145 positioned adjacent to the plurality of shock absorbent hemispheres 130. The foam pads 145 have a top end 150 and a bottom end 155. The foam pads 145 are configured to provide support, shock absorption, and to deform under load and transmit impact forces in all directions. The foam pads 145 are also configured to recover to their original shape when an impact force is removed.

In some embodiments, the foam pads 145 may be generally rectangular in shape, while in some embodiments the foam pads 145 may be substantially square, circular, or have any other desired shape, as will be appreciated by persons of ordinary skill in the art having the benefit of the instant disclosure. Further, in some embodiments, the foam pads 145 may include reinforcing or bracing structures, such as struts, ribs, braces, rods, or any other suitable reinforcing structure, or combinations thereof.

The plurality of foam pads 145 may be constructed from any desired light-weight foam material sufficient to absorb an impact force to the durable outer shell 105. For example, the plurality of foam pads 145 may be formed from foam, foam rubber, low density foam, medium density foam, high density foam, closed-cell foam, open-cell foam, polyether foam, plastic, polymers, composites, combinations thereof, and the like.

The foam pads 145 are positioned throughout the shock absorbent middle layer 120 so as to provide shock absorption to a user of the protective athletic helmet 100. For example, in some embodiments the foam pads 145 may be positioned at common impact points, at the front, back, or sides of the protective athletic helmet 100. In some embodiments the foam pads 145 may be clustered or grouped together to provide increased shock absorption at impact point. Further, in some embodiments the foam pads 145 may be evenly distributed and positioned throughout the shock absorbent middle layer 120. In some embodiments, the foam pads 145 may be positioned to form a tile, mosaic, or other pattern or design.

The number of foam pads 145 positioned in the shock absorbent middle layer 120 is preferably between 10 and 20. However, as will be readily apparent to one of ordinary skill in the art having the benefit of the instant disclosure, the number of foam pads 145 may vary, depending upon the desired weight of the protective athletic helmet 100 and the desired number of shock absorbent hemispheres 130. As one of ordinary skill in the art will readily appreciate with the benefit of the instant disclosure, in some embodiments the number of foam pads 145 may be at a number varying between 2 and 10, or between 10 and 20, or between 20 and 30, or between 30 and 50, for example.

As shown in FIG. 2, the protective athletic helmet 100 includes a flexible inner shell 160. The flexible inner shell 160 has an outer surface 165 and an inner surface 170. The outer surface 165 of the flexible inner shell 160 detachably connected to the bottom ends 140 of the plurality of shock absorbent hemispheres 130 and the bottom ends 155 of the plurality of foam pads 145. The flexible inner shell 160 configured to receive a user's head.

The flexible inner shell 160 may be any desired shape sufficient to protect the head of a user, including a substantially circular, oval, square, or rectangular shape. In some embodiments the flexible inner shell 160 may be substantially circular in shape, while in some embodiments, the flexible inner shell 160 may be substantially square or may have any other desired shape, as will be appreciated by persons of ordinary skill in the art having the benefit of the instant disclosure.

The flexible inner shell 160 may be constructed from any desired material that is sufficiently flexible, durable, and lightweight to protect a user of the protective athletic helmet 100. For example, the flexible inner shell 160 may be constructed from propylene, polypropylene, polyethylene, co-polypropylene, plastics, polymers, thermoplastic polymers, ceramics, non-metals, resins, composite materials, combinations thereof, and the like. In some embodiments, the flexible inner shell 160 may have a thickness of approximately ⅛ of an inch. While, in other embodiments, the flexible inner shell 160 may have a thickness less than ⅛ of an inch or greater than ⅛ of an inch, depending upon the desired weight of the protective athletic helmet 100. Preferably, the flexible inner shell 160 is formed from polypropylene. Polypropylene is a flexible and lightweight synthetic resin that is a polymer of propylene, and is commonly used for ropes, fabrics, and molded objects. While polypropylene is preferred, it should be understood, that the flexible inner shell 160 may be constructed from any material that is sufficiently flexible, durable, and lightweight so as to protect a user of the protective athletic helmet 100. Further, in some embodiments, the flexible inner shell 160 may also include reinforcing or bracing structures, such as struts, ribs, braces, rods, or any other suitable reinforcing or bracing structure, or combinations thereof.

The outer surface 165 of the flexible inner shell 160 is detachably connected to the bottom ends 140 of the plurality of shock absorbent hemispheres 130 and the bottom ends 155 of the plurality of foam pads 145. The outer surface 165 of the flexible inner shell 160 may be detachably connected to the bottom ends 140 of the plurality of shock absorbent hemispheres 130 and the bottom ends 155 of the foam pads 145 via adhesives, fasteners, Velcro, or any other form of connector known in the art. In some embodiments, the flexible inner shell 160 may be detachably connected to the plurality of shock absorbent hemispheres 130 or the plurality of foam pads 145 or combinations thereof. Alternatively, both the foam pads 145 and the plurality of shock absorbent hemispheres 130 may be detachably connected to the outer surface 165 of the inner flexible shell 160.

The flexible inner shell 160 is configured to be detachably connected to the shock absorbent middle layer 120. The flexible inner shell 160 is also configured to be detachably connected to the durable outer shell 105. The outer durable shell 105 and the inner flexible shell 160 are configured to permit the durable outer shell 105 to move independently from the flexible inner shell 160 and to permit the shock absorbent middle layer 120 to absorb energy resulting from an impact force to the outer surface 110 of the durable outer shell 105. One of ordinary skill in the art having the benefit of the instant disclosure, however, would readily appreciate that the flexible inner shell 160 may be permanently or semi-permanently connected to the durable outer shell 105 or the permanently or semi-permanently connected to the shock absorbent middle layer 120 in some embodiments so as to provide greater stability or rigidity to the protective athletic helmet 100.

Figure 4:
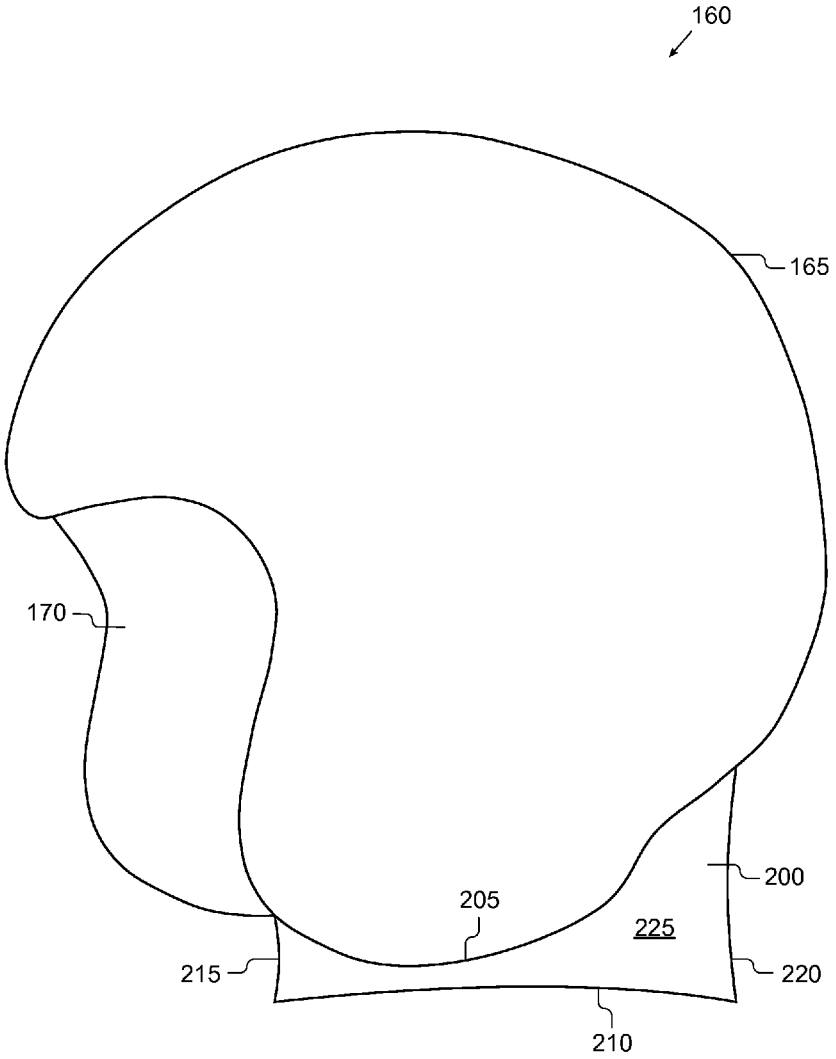
FIG. 4 is a perspective view of a neck support member connected to the flexible inner shell of the protective athletic helmet of FIG. 1.

Referring now to FIG. 4, shown therein is an embodiment of the protective athletic helmet 100, further including a flexible neck support member 200. The flexible neck support member 200 has a top end 205, a bottom end 210, and first and second sides 215 and 220 extending between the top end 205 and the bottom end 210 defining a plane 225. The top end 205 of the flexible neck support member 200 is detachably connected to a bottom portion of the flexible inner shell 160.

The flexible neck support member 200 may be any desired shape sufficient to protect the neck of a user, including a substantially circular, oval, square, or rectangular shape. In some embodiments the flexible neck support member 200 may be substantially circular in shape, while in some embodiments, the flexible inner shell 160 may be substantially square or may have any other desired shape, as will be appreciated by persons of ordinary skill in the art having the benefit of the instant disclosure.

The flexible neck support member 200 may be constructed from any desired material that is sufficiently flexible, durable, and lightweight to protect the neck of a user of the protective athletic helmet 100. For example, the flexible neck support member 200 may be constructed from propylene, polypropylene, polyethylene, co-polypropylene, plastics, polymers, thermoplastic polymers, ceramics, non-metals, resins, composite materials, combinations thereof, and the like. Preferably, the flexible neck support member 200 is formed from polypropylene. Polypropylene is a flexible and lightweight synthetic resin that is a polymer of propylene, and is commonly used for ropes, fabrics, and molded objects. While polypropylene is preferred, it should be understood, that the flexible neck support member 200 may be constructed from any material that is sufficiently flexible, durable, and lightweight so as to protect the neck of a user of the protective athletic helmet 100. Further, in some embodiments, the flexible neck support member 200 may also include reinforcing or bracing structures, such as struts, ribs, braces, rods, or any other suitable reinforcing or bracing structure, or combinations thereof.

The top end 205 of the flexible neck support member 200 is detachably connected to a bottom portion of the inner flexible shell 160. The top end 205 of the flexible neck support member may be detachably connected to a bottom portion of the inner flexible shell 160 via adhesives, fasteners, snaps, buttons, Velcro, or any other form of connector known in the art. The flexible neck support member 200 is configured to be detachably connected to the flexible inner shell 160, so that the flexible neck support member 200 may be connected to and disconnected from the flexible inner shell 160, in the event of a neck injury to a user of the protective athletic helmet 100.

In use, the flexible neck support member 200 is configured so as to slide underneath the neck of a user of the protective athletic helmet 100 laying on a ground surface and to the flexible inner shell 160. In this manner, the flexible neck support member 200 is configured to be used as a portable neck brace that may be utilized without the need to move or reposition the user. While the flexible neck member 200 is configured to be detachably connected to the flexible inner shell 160 it should be understood that in some embodiments, the flexible neck member 200 may be permanently connected to the flexible inner shell 60.

Figure 5:
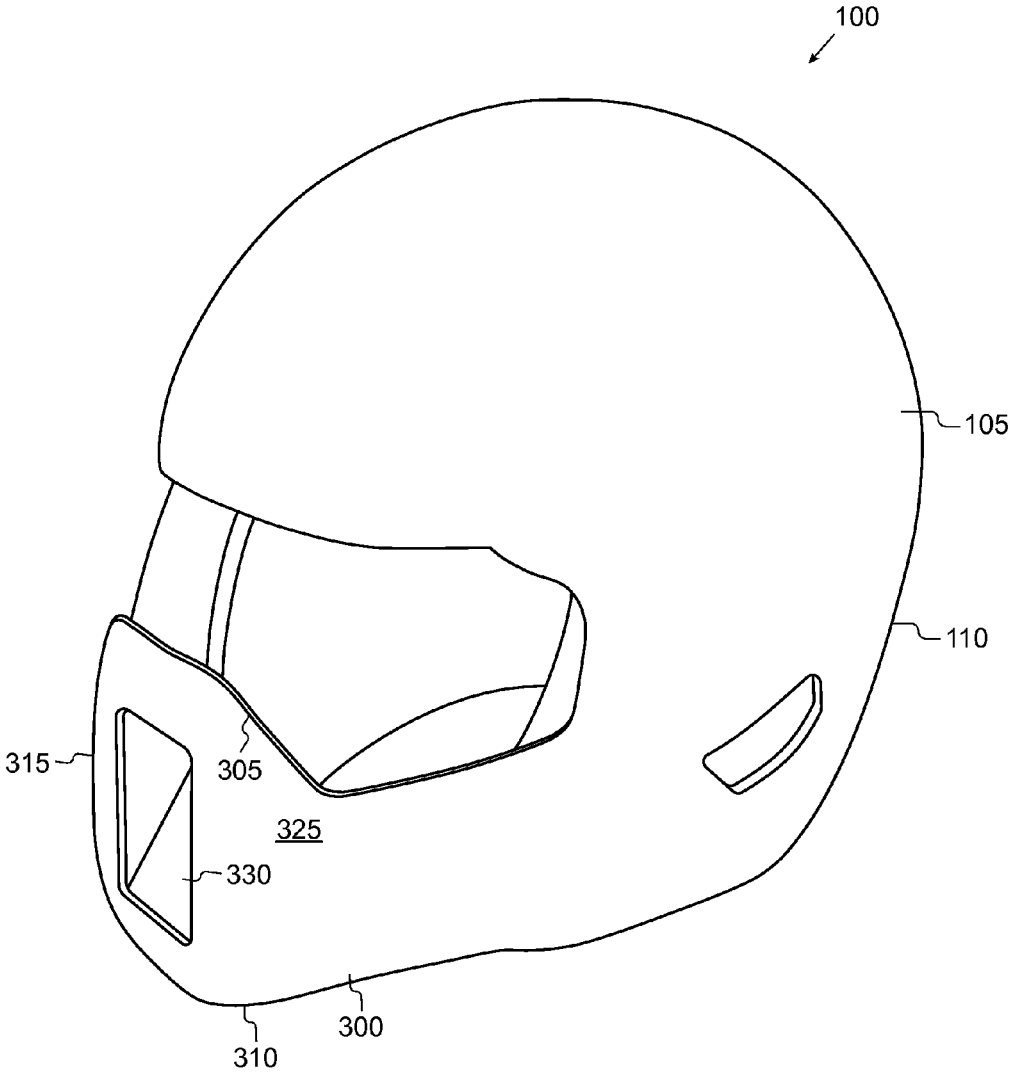
FIG. 5 is a perspective view of a lower face guard connected to the durable outer shell of the protective athletic helmet of FIG. 1.
Figure 6:
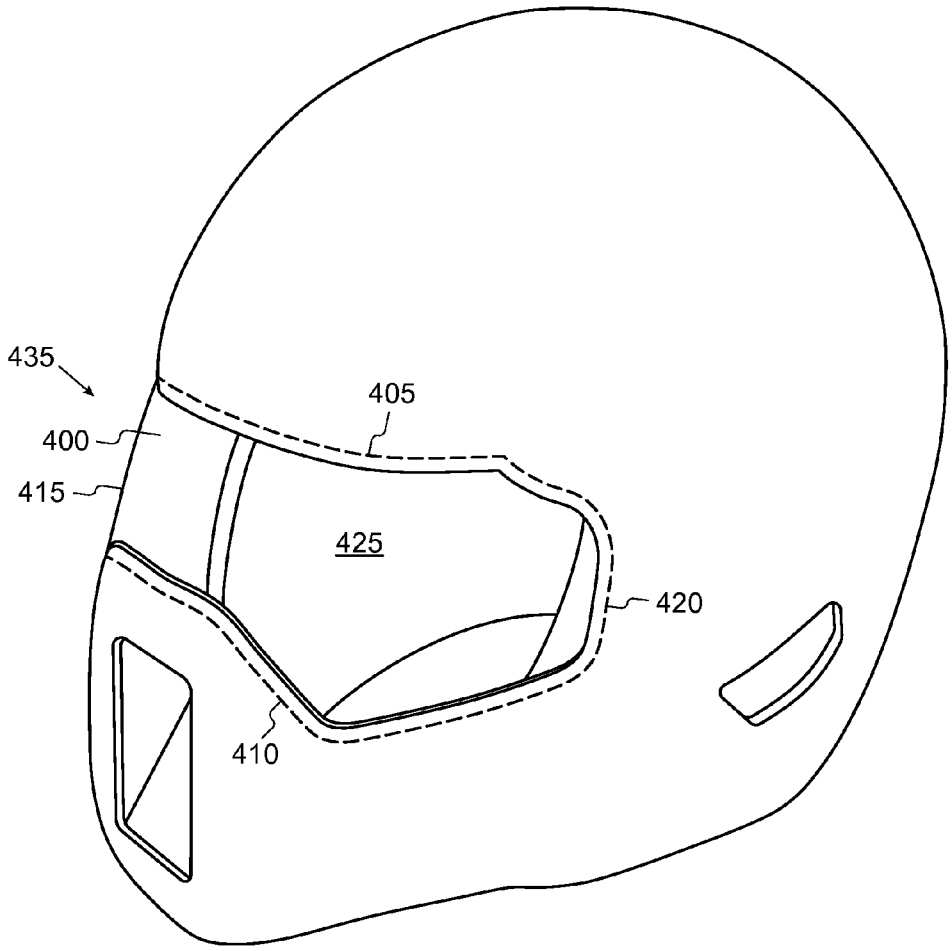
FIG. 6 is a perspective view of a substantially transparent upper face guard connected to the durable outer shell of the protective athletic helmet of FIG. 1.

Referring now to FIGS. 5-6, shown therein is an embodiment of the protective athletic helmet 100, further including a lower face guard 300 integrally connected to the durable outer shell 105 and further including a substantially transparent upper face guard 400 connected to the outer surface 110 of the durable outer shell 105. As shown in FIG. 5, the lower face guard 300 includes a top end 305, a bottom end 310, and first and second sides 315 and 320 extending between the top end 305 and the bottom end 310 defining a plane 325. The lower face guard 300 also includes at least one opening 330 extending through the plane 325. As shown in FIG. 6, the substantially transparent upper face guard 400 includes a top end 405, a bottom end 410, and first and second sides 415 and 420 extending between the top end 405 and the bottom end 410 defining a plane 425.

The lower face guard 300 is configured to be contoured to the shape of the durable outer shell 105 and to protect the lower face, chin, mouth and teeth of a user. In some embodiments, the lower face guard 300 is shown as being integrally connected to the durable outer shell 105 such that the lower face guard 300 and durable outer shell 105 are constructed from a single piece of material. However, one of ordinary skill in the art would readily appreciate with the benefit of the instant disclosure that the lower face guard 300 may be connected to the durable outer shell 105 via fasteners, hinges, bolts, screws, adhesives, combinations thereof, and the like.

The lower face guard 300 may be any desired shape sufficient to protect the lower face, jaw, mouth and teeth of a user, including a substantially circular, oval, square, or rectangular shape. In some embodiments the lower face guard 300 may be substantially circular in shape, while in some embodiments, the lower face guard 300 may be substantially square or may have any other desired shape, as will be appreciated by persons of ordinary skill in the art having the benefit of the instant disclosure.

The lower face guard 300 may be constructed from any desired material that is sufficiently durable and sufficiently lightweight to protect the lower face, jaw, mouth and teeth of a user of the protective athletic helmet 100. For example, the lower face guard 300 may be constructed from carbon fiber, carbon fiber tiles, layered or crossed carbon fiber, reinforced carbon fiber, co-polypropylene, plastics, ceramics, polymers, metals, alloys, non-metals, resins, composite materials, combinations thereof, and the like. Preferably, the lower face guard 300 is formed from carbon fiber, carbon fiber tiles, or layered, crossed, or reinforced carbon fiber. Carbon fiber provides a durable and lightweight material consisting of thin, strong crystalline filaments of carbon. While carbon fiber is preferred, it should be understood, that the lower face guard 300 may be constructed from any material that is sufficiently durable and lightweight so as to protect the lower face, jaw, mouth and teeth of a user of the protective athletic helmet 100. Further, in some embodiments, the lower face guard 300 may also include reinforcing or bracing structures, such as struts, ribs, braces, rods, or any other suitable reinforcing or bracing structure, or combinations thereof.

As shown in FIG. 6, the substantially transparent upper face guard 400 is connected to the durable outer shell 105. As one of ordinary skill in the art will readily appreciate having the benefit of the instant disclosure, the substantially transparent upper face guard 400 may be connected to the durable outer shell 105 via fasteners, hinges, bolts, screws, adhesives, combinations thereof, and the like. The substantially transparent upper face guard 400 includes a top end 405 a bottom end 410 and first and second sides 415 and 420 extending between the top end 405 and the bottom end 410 defining a plane 425. The substantially transparent upper face guard 400 is configured to be contoured to the shape of the durable outer shell 105. The substantially transparent upper face guard 400 may be any desired shape sufficient to protect the upper face, cheeks, and eyes of a user, including a substantially circular, oval, square, or rectangular shape. In some embodiments the substantially transparent upper face guard 400 may be substantially circular in shape, while in some embodiments, the upper face guard may be substantially square or may have any other desired shape, as will be appreciated by persons of ordinary skill in the art having the benefit of the instant disclosure.

The substantially transparent upper face guard 400 may be constructed from any desired material that is sufficiently transparent, durable, and lightweight to protect the upper face, cheeks, and eyes of a user of the protective athletic helmet 100 while permitting a user to see through the substantially transparent upper face guard 400. For example, the substantially transparent face guard 400 may be constructed from plastics, polymers, non-metals, resins, composite materials, combinations thereof, and the like. Further, in some embodiments, the substantially transparent upper face guard 400 may also include reinforcing bars or bracing structures, such as struts, ribs, braces, rods, or any other suitable reinforcing or bracing structure, or combinations thereof. The reinforcing bars or bracing structures may be formed from carbon fiber, co-polypropylene, plastics, ceramics, polymers, metals, alloys, non-metals, resins, composite materials, combinations thereof, and the like.

It is to be appreciated that embodiments of the protective athletic helmet 100 may be shipped with the protective athletic helmet 100 fully or partially assembled, or with the protective athletic helmet 100 fully or partially disassembled in the form of a kit, as will be readily appreciated by persons of ordinary skill in the art having the benefit of the instant disclosure.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the broad scope of the inventive concepts disclosed herein and defined by the appended claims.

What is claimed is:

1. A protective athletic helmet, comprising:

a durable outer shell having an outer surface and an inner surface, the durable outer shell configured to be contoured to the shape of a user's head;

a shock absorbent middle layer configured to be contoured to the shape of a user's head, the shock absorbent middle layer detachably connected to a portion of the inner surface of the durable outer shell, the shock absorbent middle layer having a plurality of shock absorbent hemispheres having top and bottom ends, and a plurality of foam pads having top and bottom ends, the plurality of shock absorbent hemispheres positioned adjacent to the plurality of foam pads such that each one of the shock absorbent hemispheres are spaced apart having the plurality of foam pads therebetween; and a flexible inner shell having an outer surface and an inner surface, the outer surface of the flexible inner shell detachably connected to the bottom ends of the plurality of shock absorbent hemispheres and the bottom ends of the foam pads, the flexible inner shell configured to receive a user's head;

wherein the outer durable shell and the inner flexible shell are configured to permit the durable outer shell to move independently from the flexible inner shell and to permit the shock absorbent middle layer to absorb energy resulting from an impact force to the outer surface of the durable outer shell.

2. The protective athletic helmet of claim 1, wherein the plurality of shock absorbent hemispheres are positioned at a front, a back, and a first and second side of the shock absorbent middle layer, so as to provide increased shock absorption and protection from impact forces to the durable outer shell.

3. The protective athletic helmet of claim 1, wherein the plurality of shock absorbent hemispheres are formed from Sorbothane.

4. The protective athletic helmet of claim 1, wherein the plurality of shock absorbent hemispheres are formed from a visco-elastic polymer.

5. The protective athletic helmet of claim 1, wherein the plurality of shock absorbent hemispheres are formed from a thermoset polyether-based polyurethane material.

6. The protective athletic helmet of claim 1, wherein the durable outer shell is formed from carbon fiber.

7. The protective athletic helmet of claim 1, wherein the durable outer shell is formed from co-polypropylene.

8. The protective athletic helmet of claim 1, wherein the flexible inner shell is formed from polypropylene.

9. The protective athletic helmet of claim 1, wherein the flexible inner shell is formed from polyethylene.

10. The protective athletic helmet of claim 1, further comprising a flexible neck support member having a top end, a bottom end, and first and second sides extending between the top end and the bottom end defining a plane, the top end of the flexible neck support member detachably connected to a bottom portion of the flexible inner shell.

11. The protective athletic helmet of claim 1, further comprising a lower face guard connected to the durable outer shell, the lower face guard having a top end, a bottom end, and first and second sides and extending between the top end and the bottom end defining a plane, the lower face guard including at least one opening extending through the plane.

12. The protective athletic helmet of claim 1, further comprising a substantially transparent upper face guard connected to the outer surface of the durable outer shell, the substantially transparent upper face guard having a top end a bottom end and first and second sides extending between the top end and the bottom end defining a plane.

* * * * *